US005273474A

United States Patent [19]

Oshima et al.

[11] Patent Number: 5,273,474

[45] Date of Patent: Dec. 28, 1993

[54] METHOD OF MANUFACTURING A CENTER ELECTRODE FOR A SPARK PLUG

[75] Inventors: Takafumi Oshima; Tsutomu Okayama, both of Nagoya, Japan

[73] Assignee: NGK Spark Plug Co., Ltd., Nagoya, Japan

[21] Appl. No.: 979,287

[22] Filed: Nov. 20, 1992

[30] Foreign Application Priority Data

Dec. 3, 1991 [JP] Japan ..... 3-319107

[51] Int. Cl.[5] ..... H01T 21/02

[52] U.S. Cl. ..... 445/7; 313/141; 219/121.64

[58] Field of Search ..... 445/7; 313/141; 219/121.64

[56] References Cited

U.S. PATENT DOCUMENTS

| | | | |
|---|---|---|---|
| 2,217,825 | 10/1940 | Twining et al. | 313/141 |
| 2,783,409 | 2/1957 | McDougal | 313/141 |
| 4,786,267 | 11/1988 | Toya et al. | 445/7 |
| 4,859,827 | 8/1989 | Coyle, Jr. et al. | 219/121.64 |
| 4,868,365 | 9/1989 | Farone et al. | 219/121.64 |
| 4,893,051 | 1/1990 | Kondo | 313/141 |

FOREIGN PATENT DOCUMENTS

| | | | |
|---|---|---|---|
| 0418055 | 3/1991 | European Pat. Off. | 313/141 |

*Primary Examiner*—Mark Rosenbaum
*Assistant Examiner*—Jeffrey T. Knapp
*Attorney, Agent, or Firm*—Cooper & Dunham

[57] ABSTRACT

In a method of manufacturing a center electrode for a spark plug, a composite column is provided by enclosing a heat-conductor core into a nickel-alloyed clad by means of plastic working. A front end of the nickel-alloyed clad is severed to define a severing and surface with which an axial bore is provided to reach to a front end of the heat-conductor core. A straight neck portion around the axial bore is provided by diametrically reducing the front end of the nickel-alloyed clad. A firing tip made of precious metal is placed in the axial bore. A front end of the firing tip extends beyond the front end of the straight neck portion, while a rear end of the firing tip comes to be in thermally transferable contact with the front end of the heat-conductor core. An outer surface of the firing tip is bonded to an inner surface of the axial bore by means of laser beam welding or electron beam welding.

11 Claims, 11 Drawing Sheets 402
401
201
101

201a
404
402
201
101

11a 11a
407
201
101

3
30
11a
201
101

3
11
11a
A
1
(101)
2
(201)

METHOD OF MANUFACTURING A CENTER ELECTRODE FOR A SPARK PLUG

BACKGROUND OF THE INVENTION

Field of the Invention

This invention relates to a method of manufacturing a center electrode for a spark plug in which a spark-erosion resistant firing tip is welded to a front end of a center electrode.

In a spark plug for an internal combustion engine, a firing tip is welded to a front end of a center electrode. It is known that the tip is made of a noble metal such as platinum-based alloy to impair a spark erosion property with the front end of the center electrode.

It is considered to diametrically reduce the firing tip in order to maintain good sparking or ignitability condition of the spark plug. The diametrically reduced tip, however, exceedingly rises its temperature to accelerate its spark erosion by oxidation-evaporation and dispersion, although it advantageously concentrates spark discharge to lower the spark discharge voltage.

Therefore, the invention is made on the basis of the concept that a heat-conductor core is enclosed in a nickel-alloyed metal so as provide an heat escape path from the firing tip to the heat-conductor core, thus preventing the temperature of the firing tip from exceedingly rising.

It is an object of the invention to provide a method of manufacturing a center electrode for spark plug in which a firing tip is provided in thermally transferable relationship with the heat-conductor core, thus effectively preventing the firing tip from being worn so as to contribute to an extended service life with minimum cost.

SUMMARY OF THE INVENTION

According to the invention, there is provided a method of making a center electrode for spark plug comprising steps of: providing a composite column by enclosing a heat-conductor core into a nickel-alloyed clad by means of plastic working; severing a front end of the nickel-alloyed clad to define a severing end surface; providing an axial bore at the severing end surface of the nickel-alloyed clad to reach to a front end of the heat-conductor core; providing a straight neck portion around the axial bore by diametrically reducing the front end of the nickel-alloyed clad; providing a firing tip made of precious metal into the axial bore, a front end of the firing tip extending beyond the front end of the straight neck portion, while a rear end of the firing tip being in thermally transferable contact with the front end of the heat-conductor core; and bonding an outer surface of the firing tip to an inner surface of the axial bore by means of laser beam welding or electronic beam welding.

With the provision of the straight neck portion, a volume of the front end of the nickel-alloyed clad is reduced so as to prevent the firing tip from melting due to welding heat at the time when the firing tip is welded to the straight neck portion.

With the structure, the firing tip comes to thermally transferable contact with the heat-conductor core, and providing a heat escape path from the firing tip to the heat-conductor core, thus preventing exceeding temperature rise of the firing tip so as to impair spark erosion property to the firing tip when the firing tip is diametrically reduced.

By means of laser beam welding or electronic beam welding, the firing tip is securely welded to the straight neck portion so as to avoid the firing tip from inadvertently falling off the straight neck portion due to heat-cool cycle during operation.

Further, the step of providing the straight neck portion may precede the step of providing the axial bore.

With the provision of the thermal treating step, the residual stress is removed so as to prevent a center electrode from unfavorably deforming, and avoiding to break a tubular insulator during operation. The thermal treating step may be preferably carried out after the welding step. It is preferable that the thermal treating step may precede the step of providing the axial bore when the axial bore is formed by means of blanking.

The laser beams are directed at an angle of 45 degrees against the composite column at the time of bonding the outer surface of the firing tip to the inner surface of the axial bore by means of the laser beam welding.

This enables to hermetically weld the firing tip to the straight neck portion without involving the heat-conductor core in the welding portion, and preventing an entry of combustion gas into the axial bore.

With the relationship among D, d and L as 0.2 mm$\leqq$(D-d)/2$\leqq$0.5 mm and 0.2 mm$\leqq$L$\leqq$1.0 mm, the firing tip is readily welded to the straight neck portion with stabilized welding strength. (D-d)/2 represents a thickness of the straight neck portion which is equivalent to half the difference between an outer diameter (D) of the straight neck portion and an inner diameter (d) of the axial bore and L represents a length of the straight neck portion.

If the dimension of (D-d)/2 is less than 0.2 mm, the nickel-alloyed clad comes short of strength so that cracks occurs on a rear end of the straight neck portion due to thermal stress.

The dimension of (D-d)/2 exceeding 0.5 mm requires an increased output of the laser beam welding so as to melt the firing tip.

If the dimension L exceeds 1.0 mm, cracks occur on a rear end of the straight neck portion due to thermal stress during the heat-cool cycle operation.

When the dimension L is less than 0.2 mm, the nickel-alloyed clad tends to absorb a considerable amount of heat at the time of welding the firing tip to the straight neck portion, thus requiring an increased output of the laser beam welding so as to melt the firing tip.

Unless the difference between the outer diameter of the firing tip and the inner diameter of the straight neck portion is within a range of less than 0.5 mm, an increased number of voids appears in the welding portion between the firing tip and the straight neck portion.

The length of the firing tip exceeding 1.5 mm comes short of heat-dissipating property so as to rise its temperature to result in an increased amount of spark-erosion.

By providing the flange with the front end of the firing tip, the spark-erosion resistant property is impaired to the firing tip, while reduced temperature of the center electrode is maintained.

The laser beams are directed perpendicular to an interface between the flange and a front end of the straight neck portion at the time of bonding the firing tip to the straight neck portion by means of the laser beam welding.

Thus the welding portion makes it possible to hermetically seal the interface between the flange and the front end of the straight neck portion.

By providing the recess with the front end surface of the flange, the flange is divided into plural areas, thus increasing an intensity of electrical field between the center electrode and an outer electrode so as to lower the spark discharge voltage therebetween.

The recess is provided prior to inserting the firing tip to the axial bore, so that shape of the recess can be precisely maintained to reduce the variation of the spark discharge voltage.

Furthermore, the pressure is applied in the direction in which the firing tip is brought into engagement with the heat-conductor core after inserting the firing tip to the axial bore.

This makes it possible to strengthen the direct engagement between the firing tip and the heat-conductor core.

In addition, the pressure is applied concurrently when the firing tip is bonded to the straight neck portion by means of the laser beam welding.

This makes it possible to all the more strengthen the direct engagement between the firing tip and the heat-conductor core.

These and other objects and advantages of the invention will be apparent upon reference to the following specification, attendant claims and drawings.

DETAILED DESCRIPTION OF THE EMBODIMENTS

Figure 1:
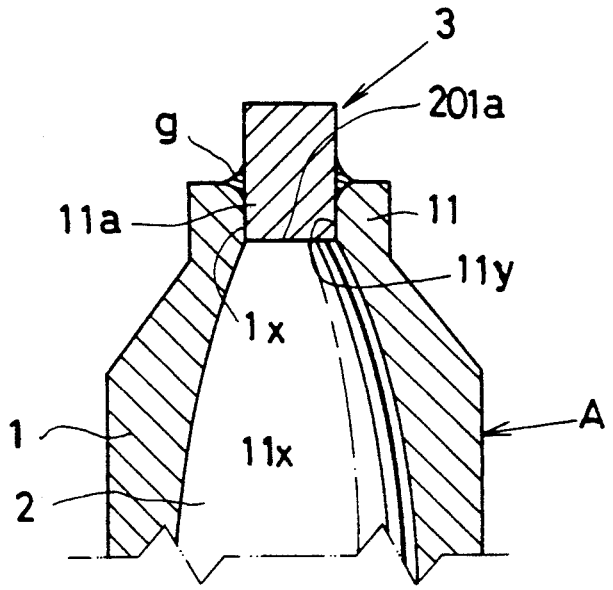
FIG. 1 is an enlarged longitudinal cross sectional view of a main part of a center electrode according to first and second embodiments of the invention.

Referring to FIG. 1, a center electrode (A) for a spark plug is shown which has a clad sheath 1 whose front end has a diameter-reduced straight neck 11. Within the clad sheath 1, is a core 2 extruded. To the straight neck 11, is a firing tip 3 inserted. A rear end of the core 2 may be exposed to outside from a rear end of the clad sheath although not shown.

Figures 2A, 2B, 2C, 2D, 2E, 2F:
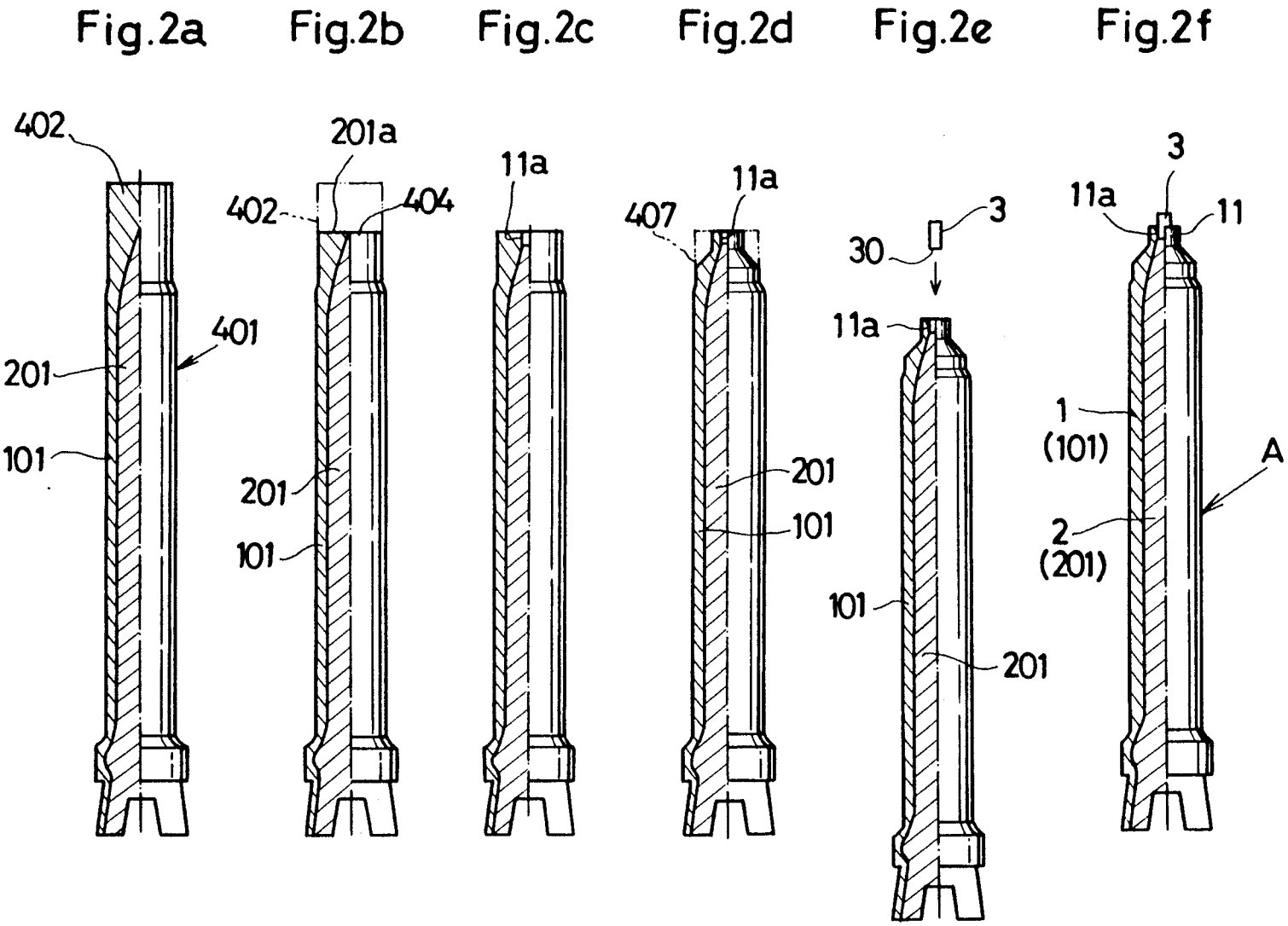
FIGS. 2*a* through 2*f* are sequential process views when the center electrode is manufactured.

The center electrode (A) thus assembled is manufactured as follows:

(1) A composite column 401 is made by means of plastic working such as extruding a heat-conductor core 201 into a nickel-alloyed clad 101 as shown in FIG. 2*a*. The heat-conductor core 201 is made of copper, while the nickel-alloyed clad 101 made of Inconel by way of illustration.

(2) A front end 402 of the nickel-alloyed clad 101 is severed to provide a front end surface 404 of the clad 101 as shown in FIG. 2*b*. The front end surface 404 of the clad 101 is milled to expose a front end 201*a* of the heat-conductor core 201 from the front end surface 404 of the clad 101.

(3) A drilling tool is applied on a center of the front end surface 404 of the clad 101 to provide an axial bore 11*a* concentrically with the nickel-alloyed clad 101 and the heat-conductor core 201 as shown in FIG. 2*c*. The axial bore 11*a* is provided by means of blanking.

The axial bore 11*a* is circular in cross section, and equi-diameter all through its depth. Such is the depth of the axial bore 11*a* as to be lengthwisely equivalent to a rear end portion of the firing tip 3 which is to be inserted into the axial bore 11*a* as described below. The firing tip 3 is made of precious metal such as an iridium-alloy including $Y_2O_3$ (2.5 wt %) for example.

(4) A front end 407 of the nickel-alloyed clad around axial bore 11*a* is diametrically reduced to form a straight neck tube 11 which is concentrical with the axial bore 11*a* as shown in FIG. 2*d*.

(5) The columnar firing tip 3 is inserted to the axial bore 11*a*. A rear end 30 of the tip 3 comes to be in thermally transferable contact with the front end of the heat-conductor core 201, while a front end of the tip 3 extends slightly beyond the straight neck tube 11 as shown in FIG. 2*e*.

(6) A laser beam welding makes it possible to securely bond an interface between an outer surface 11*x* of the firing tip 3 and an inner surface 11*y* of the axial bore 11*a* so as to form a welding portion (g) as shown in FIG. 2*f*.

It is appreciated that the step of providing the straight neck tube 11 precedes the step of providing the axial bore 11*a* so as to serve as a second embodiment of the invention.

The following advantages are obtained.

(i) The rear end 30 of the firing tip 3 comes to be in thermally transferable contact with the front end of the heat-conductor core 201, thus enabling to provide a heat escape path with the firing tip 3 by way of the heat-conductor core 201.

This makes it possible to avoid an excessive temperature rise of the firing tip 3 to significantly reduce its spark erosion when the tip 3 is diametrically reduced.

(ii) The straight neck tube 11 enables to favorably ignite combustion gas consecutively, and sparking the center electrode (A) with a reduced discharge voltage.

(iii) With the use of the laser beam welding, the beams are readily focused so that the laser beam welding is, as well as an electronic beam welding, better suited for welding the firing tip 3 to the straight neck tube 11.

Figure 3:
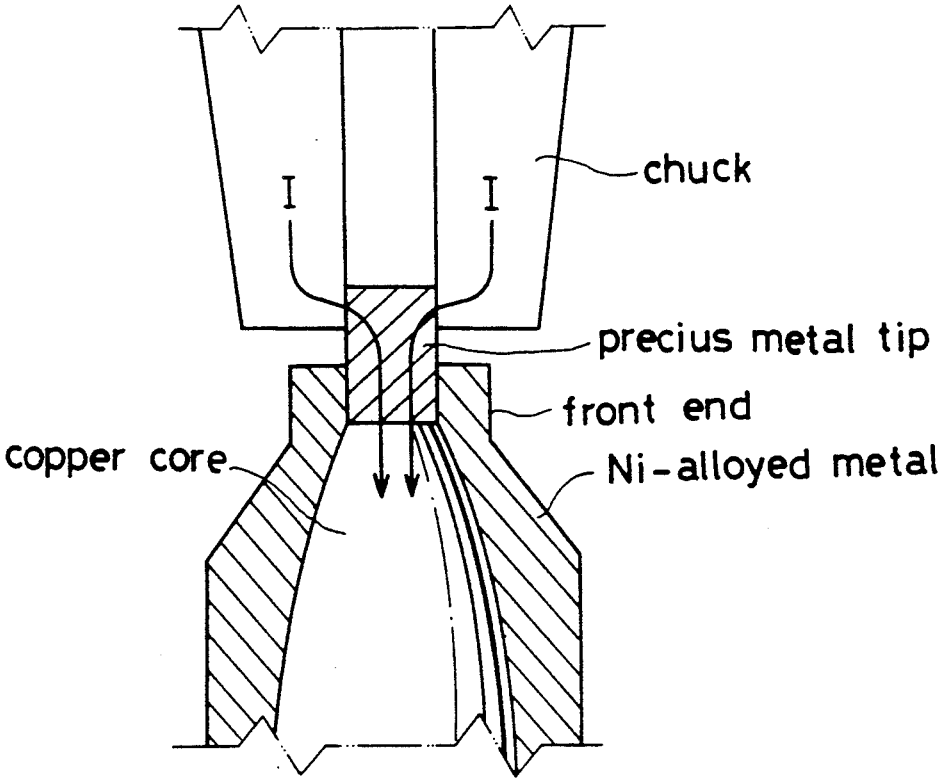
Fig. 3 PRIOR ART
FIG. 3 is an explanatory view of what inconvenience appears when electrical resistant welding is carried out.

With an employment of an electrical resistant welding, an electrical current (I) flows from a noble metal tip to a copper core, thus failing to strongly bond the tip to the front end of a nickel-alloyed metal as shown in FIG. 3.

An employment of an argon welding (TIG) makes it difficult to control an amount of output heat so as to melt the firing tip, thus rendering it difficult to keep the tip in original good shape.

After inserting the firing tip 3 as shown at step (5) in FIG. 2*e*, but before conducting the laser beam welding as shown at step (6) in FIG. 2*f* is a thermal treatment provided with the firing tip 3 and the composite column 401 in a vacuum atmosphere over recrystalization temperature for more than 30 minutes as exemplified by a third embodiment of the invention.

Figure 4:
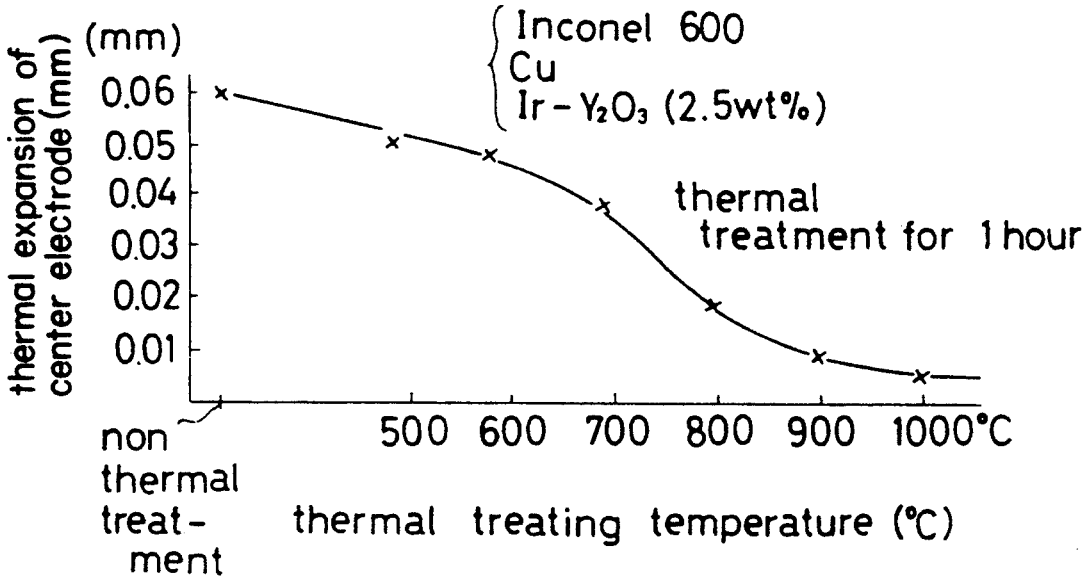
FIG. 4 is graph showing a relationship between thermal expansion of the center electrode (mm) and heat-treatment temperature (°C.) according to a third embodiment of the invention.

By way of example, when the thermal treatment is carried out in a vacuum atmosphere under the conditions of 900° C.×1 Hr., it is found that the thermal expansion of the center electrode (A) is 0.01 mm as shown in FIG. 4 after conducting a burning experimental test in which the center electrode (A) is subjected to heat-cool cycle of 900° C.×1 min. ~100° C.×1 min. 1000 times alternately.

On the contrary, the thermal expansion of the center electrode reaches 0.06 mm when non-thermal treatment is carried out as evidenced by FIG. 4.

Figure 5:
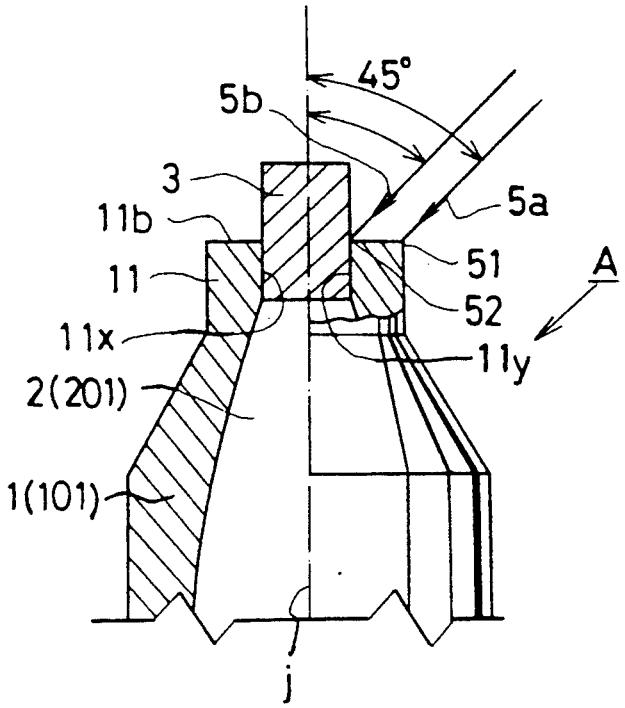
FIG. 5 is an explanatory cross sectional view when the center electrode is manufactured according to a fourth embodiment of the invention.

FIG. 5 shows a fourth embodiment of the invention in which laser beams 5*a*, 5*b* are directed to form an angle of 45 degrees against an axial direction (j) of the center electrode (A). The laser beams 5*a*, 5*b* impinge on a front end surface 11*b* of the straight neck tube 11 to cover between an innermost edge 52 and outermost edge 51 of the straight neck tube 11. This way of welding enables to hermetically seal the interface between the firing tip 3 and the straight neck tube 11 without involving the heat-conductor core 201 in the welding portion (g), thus preventing the tip 3 from bulging out of the straight neck tube 11, and at the same time, effectively avoiding an inflow of the combustion gas into the straight neck tube 11.

Figure 6:
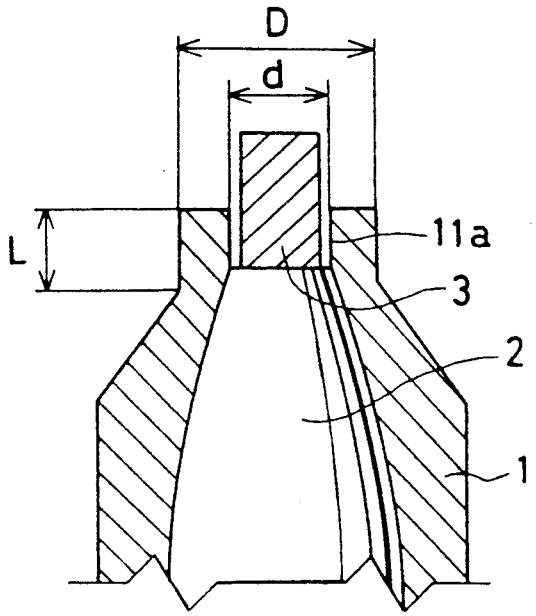
FIG. 6 is an explanatory cross sectional view when a center electrode is manufactured according to a fifth embodiment of the invention.
Figure 7:
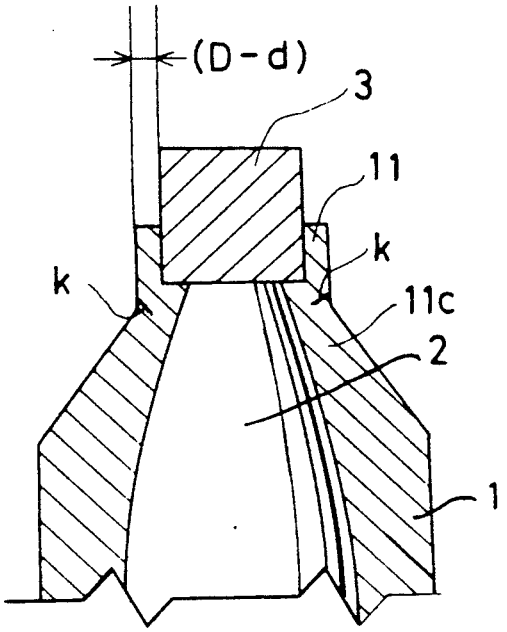
FIG. 7 is an explanatory cross sectional view of what inconvenience appears when (D-d) 12 is less than 0.2 mm.
Figure 8:
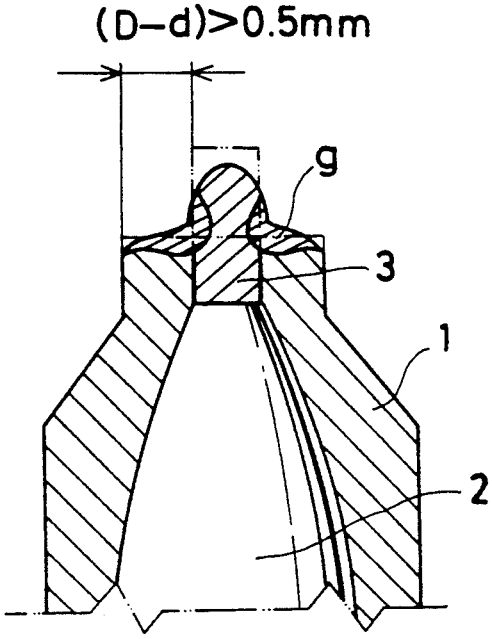
FIG. 8 is an explanatory cross sectional view of what inconvenience appears when (D-d) 12 exceeds 0.5 mm.

FIGS. 6 through 8 show a fifth embodiment of the invention in which the firing tip 3 is made of an iridium alloy including $Y_2O_3$ (2.5 wt%) with its diameter 0.5 mm. The nickel-alloyed clad 101 is made of Inconel 600. A thickness (D-d) 12 of the straight neck tube 11 is 0.3 mm, while a length (L) of the straight neck tube 11 is 0.6 mm as shown in FIG. 6. The thickness (D-d) 12 is equivalent to half the difference between an outer diameter (D) of the straight neck tube 11 and an inner diameter (d) of the axial bore 11*a*.

In order to examine an optimum range of the thickness (D-d) 12 and the length (L), an experiment test is carried out with the center electrode mounted on a 2000 cc, six-cylinder engine which is alternately operated in accordance with heat-cool cycle from full throttle 5000 rpm×1 min. to an idle rpm×1 min.

As a result, it is found that it is favorable when the thickness (D-d) 12 falls within a range from 0.2 mm to 0.5 mm (more preferably 0.25 mm~0.35 mm), while the length (L) within a range from 0.2 mm to 1.0 mm (more preferably 0.5 mm~0.8 mm).

If the thickness (D-d) 12 is less than 0.2 mm, the nickel-alloyed clad 101 becomes short of sufficient strength, and cracks (k) appear on a rear end 11*c* of the straight neck tube 11 due to thermal stress as shown in FIG. 7.

In the meanwhile, the thickness exceeding 0.5 mm results in an increased output of the laser beam welding which melts the firing tip 3 as shown in FIG. 8.

The length (L) exceeding 1.0 mm causes cracks to appear on the straight neck tube 11 due to thermal stress, while the length (L) less than 0.2 mm contributes for the straight neck tube 11 to absorb a large amount of heat at the time of welding the firing tip 3, thus requiring an increased output for the laser beam welding to compensate an amount of heat absorbed by the nickel-alloyed clad 101, eventually causing to melt the firing tip and the nickel-alloyed clad.

Figure 9:
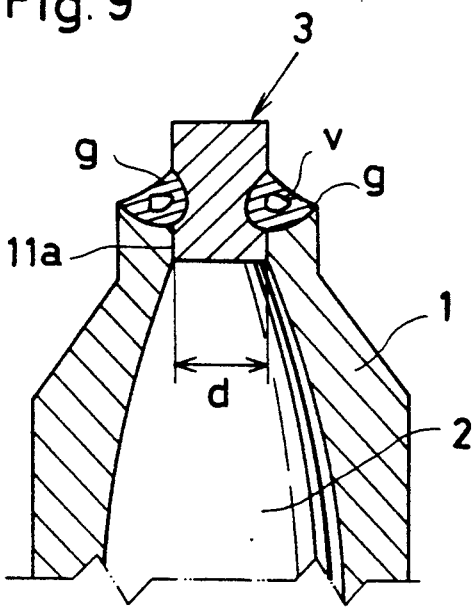
FIG. 9 is an explanatory cross sectional view when the center electrode is manufactured according to a sixth embodiment of the invention.
Figure 10:
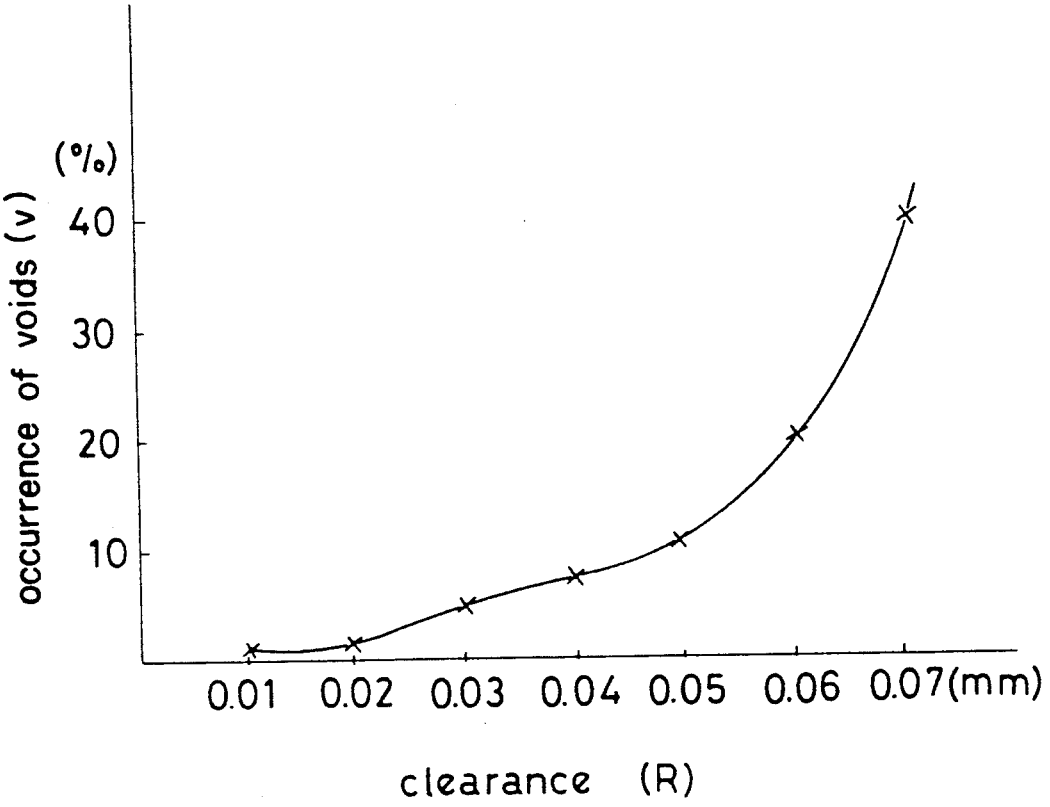
FIG. 10 is graph showing a relationship between occurrence of voids (%) and clearance (R) according to the sixth embodiment of the invention.

FIGS. 9 and 10 show a sixth embodiment of the invention in which the length (L) of the firing tip 3 is less than 1.5 mm inclusive, while an outer diameter of the firing tip 3 is smaller than the diameter (d) of the axial bore 11*a* by at most 0.05 mm as shown in FIG. 9.

When a clearance (R) between the diameter (d) of the axial bore 11*a* and the outer diameter of the firing tip 3 exceeds 0.05 mm, it is found that voids (v) appear on the welding portion (g).

It is also found that the length (L) of the firing tip 3 exceeding 1.5 mm causes to reduce its heat-dissipating effect, and bring an excessive temperature rise so as to accelerate the spark erosion. FIG. 10 shows a relationship between the occurrence of voids (v) and the clearance (R) when the firing tip 3 is 1.3 mm in length (L) and 0.5 mm in diameter, while the straight neck tube 11 is 0.6 mm in length and 1.1 mm in diameter.

Figure 11:
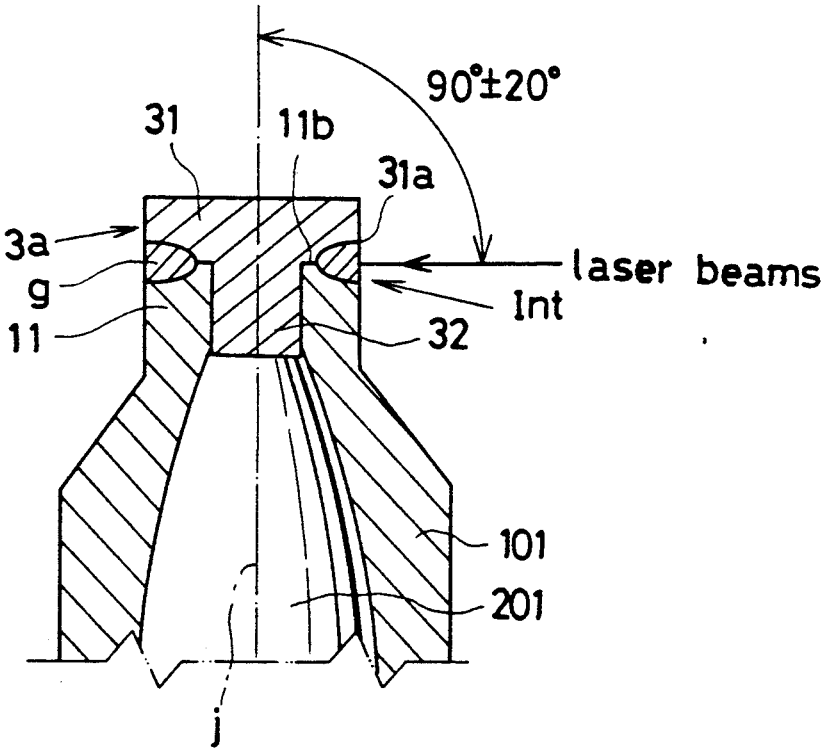
FIG. 11 is an explanatory cross sectional view when a center electrode is manufactured according to a seventh embodiment of the invention.

FIG. 11 shows a seventh embodiment of the invention in which a front end of a firing tip 3*a* integrally has a circular flange 31 whose diameter (1.2 mm) is equivalent to that of the straight neck tube 11. The firing tip 3*a* is made of platinum alloy into which zirconia (0.06~0.3 wt%) is dispersed to enhance its mechanical strength. An employment of the laser beam welding makes it possible to bond an interface (Int) between an upper surface 31*a* of the flange 31 and the front end surface of the straight neck tube 11. In this instance, the laser beams are directed to the interface (Int) to form an angular range from 70 to 110 degrees against the axial direction (j) of the center electrode (A). In this embodiment, the flange 31 acts as a spark-erosion surface, while a diameter-reduced portion 32 of the firing tip 3*a* serves as a provider of the heat escape path toward the heat-conductor core 201 so as to improve the spark-erosion property and avoiding the excessive temperature rise.

Figure 12B:
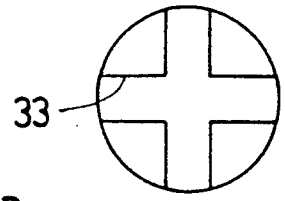
FIG. 12*b* is a plan view of a flange of a firing tip in FIG. 12*a;*
Figure 12A:
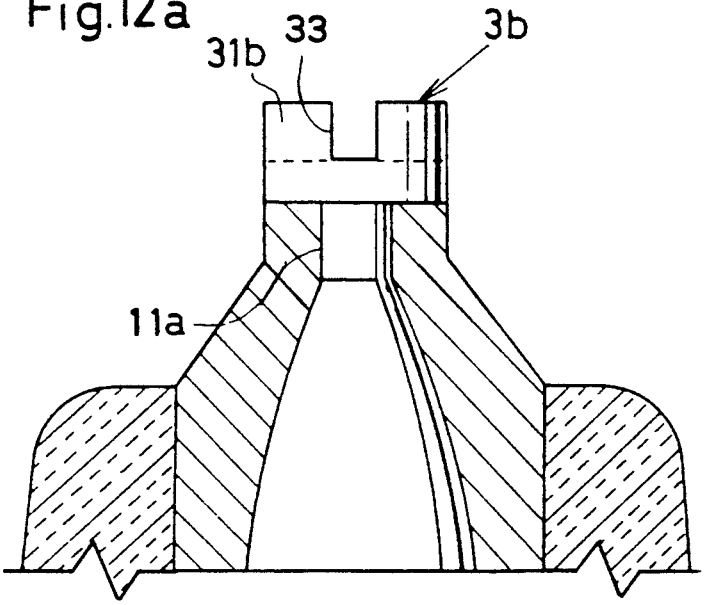
FIG. 12*a* is an enlarged longitudinal cross sectional view of a main part of a center electrode according to eighth embodiment of the invention.

FIGS. 12*a* and 12*b* show an eighth embodiment of the invention in which a front end of a firing tip 3*b* integrally has a circular flange 31*b*. The firing tip 3*b* is made of platinum alloy including zirconia (0.06 wt%). By means of header process, a criss-cross shaped groove 33 is provided with an lower surface of the flange 31*b* prior to inserting the firing tip 3*b* to the axial bore 11*a*.

Figure 13:
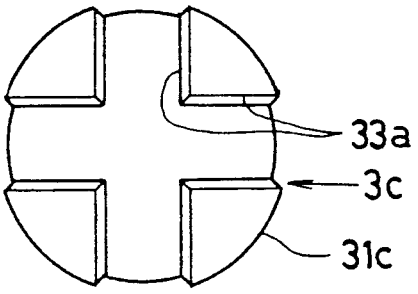
FIG. 13 is a plan view of a flange of a firing tip according to ninth embodiment of the invention.

FIG. 13 shows a ninth embodiment of the invention in which a front end of a firing tip 3*c* integrally has a circular flange 31*c*. The firing tip 3*b* is made of platinum alloy including zirconia (0.06 wt%). By means of header working process, a criss cross shaped groove 33a is provided with a lower surface of the flange 31c prior to insering the firing tip 3a to the axial bore 11a. A width of the groove 33a is somewhat larger than that of the groove 33 of FIG. 12b.

Figure 14:
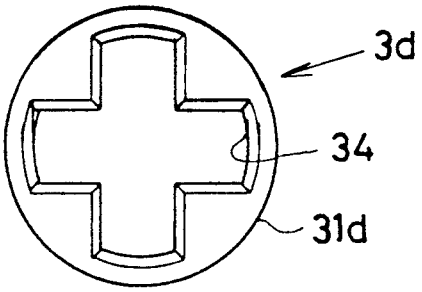
FIG. 14 is a plan view of a flange of a firing tip according to tenth embodiment of the invention.

FIG. 14 shows a tenth embodiment of the invention in which a front end of a firing tip 3d integrally has a circular flange 31d. The firing tip 3d is made of platinum alloy including zirconia (0.06 wt%). By means of the header working process, a criss cross shaped recess 34 is provided with a lower surface of the flange 31d prior to inserting the firing tip 3d to the axial bore 11a. In FIGS. 12a, 12b, 13 and 14, various dimensions are depicted concerning to the groove 33, 33a and the recess 34.

With the grooves 33, 33a and the recess 34, the flanges 31b, 31c and 31d are respectively divided into plural areas to increase an intensity of an electrical field between electrodes so as to discharge therebetween with a reduced voltage.

With the grooves 33, 33a and the recess 34 each provided with the respective flanges prior to inserting the corresponding firing tips to the axial bore 11a, the divided shape of the grooves and the recess are rigidly maintained with minimum variation of the spark discharge voltage.

Figure 15:
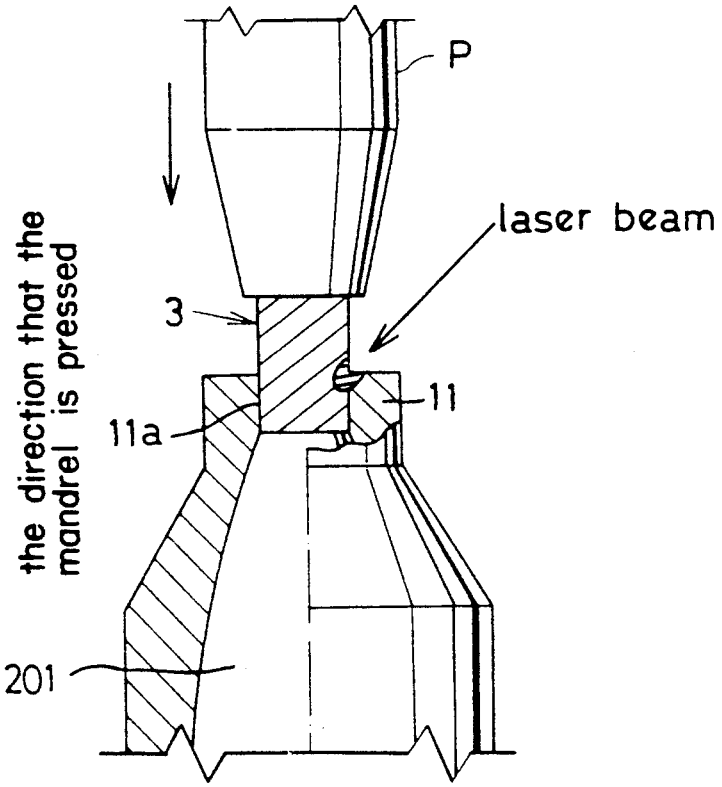
FIG. 15 is an explanatory cross sectional view when the center electrode is manufactured according to an eleventh embodiment of the invention.

FIG. 15 shows an eleventh embodiment of the invention in which the firing tip 3 is 1.5 mm in length, and the diameter of the tip 3 is smaller than that of the axial bore 11a by at most 0.05 mm. After inserting the firing tip 3 to the axial bore 11a, the firing tip 3 is pressed by a mandrel (P) in the direction in which the tip 3 is brought into engagement with the front end of the heat-conductor core 201 concurrently when the firing tip 3 is bonded to the straight neck tube 11 by means of laser beam welding.

Figure 16:
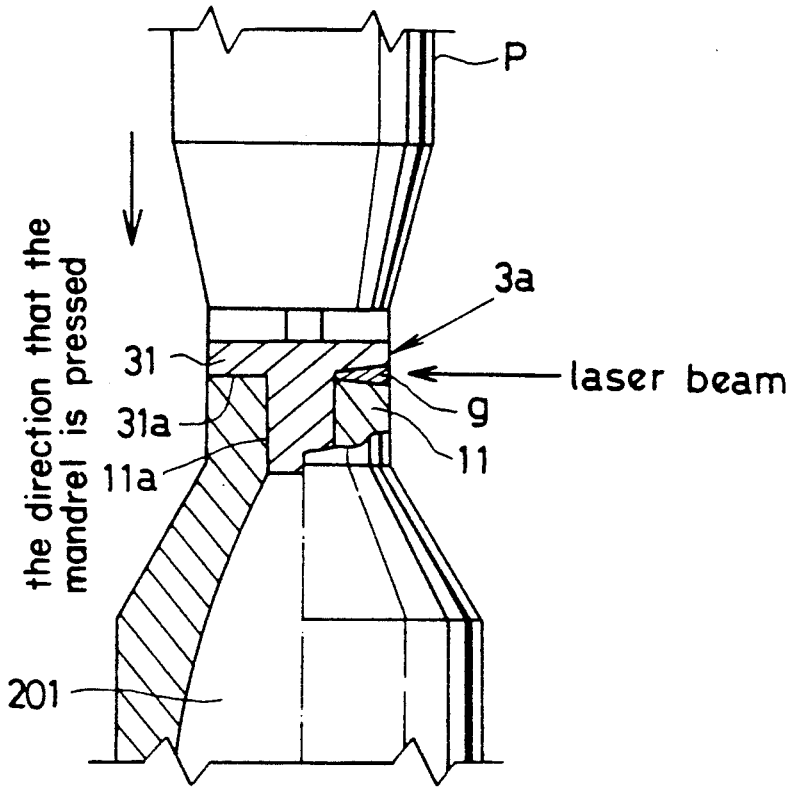
FIG. 16 is an explanatory cross sectional view when the center electrode is manufactured according to a twelfth embodiment of the invention.

FIG. 16 shows a twelfth embodiment of the invention in which the firing tip 3a described at the seventh embodiment in FIG. 11 is employed. After inserting the firing tip 3a to the axial bore 11a, the firing tip 3a is pressed by the mandrel (P) in the direction in which the tip 3 is brought into engagement with the front end of the heat-conductor core 201 concurrently when the firing tip 3a bonded to the straight neck portion 11 by means of the laser beam welding.

In each of the embodiments, the firing tip is brought in tight contact with the heat-conductor core 201 so as to achieve the heat-dissipating effect. It is noted that instead of the laser beam welding, the firing tip 3 may be bonded to the inner surface of the axial bore 11a by means of electron beam welding.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A method of manufacturing a center electrode for a spark plug comprising steps of:

providing a composite column by enclosing a heat-conductor core into a nickel-alloyed clad by means of plastic working;

severing a front end of the nickel-alloyed clad to define a severing end surface;

providing an axial bore at the severing end surface of the nickel-alloyed clad to reach to a front end of the heat-conductor core;

providing a straight neck portion around the axial bore by diametrically reducing the front end of the nickel-alloyed clad;

providing a firing tip made of precious metal into the axial bore, a front end of the firing tip extending beyond the front end of the straight neck portion, while a rear end of the firing tip being in thermally transferable contact with the front end of the heat-conductor core; and bonding an outer surface of the firing tip to an inner surface of the axial bore by means of laser beam welding or electronic beam welding.

2. A method of manufacturing a center electrode for a spark plug as recited in claim 1, further comprising a step of thermally treating the composite column and the firing tip to remove residual stress therefrom.

3. A method of manufacturing a center electrode for a spark plug as recited in claim 1, wherein laser beams are directed at an angle of 45 degrees against the composite column at the time of bonding the outer surface of the firing tip to the inner surface of the axial bore by means of the laser beam welding.

4. A method of manufacturing a center electrode for a spark plug as recited in claim 1, wherein a relationship among D, d and L is as follows:

$$0.2\text{mm} \leqq (D-d)/2 \leqq 0.5\text{mm},\ 0.2\text{mm} \leqq L \leqq 1.0\text{mm}$$

where

D: an outer diameter of the straight neck portion, d: an inner diameter of the axial bore, L: a length of the straight neck portion.

5. A method of manufacturing a center electrode for a spark plug as recited in claim 1, wherein a length of the firing tip is 1.5 mm, while an outer diameter of the firing tip is smaller by at most 0.05 mm than the inner diameter of the axial bore.

6. A method of manufacturing a center electrode for a spark plug as recited in claim 1, wherein a recess is provided with a front end surface of the flange prior to inserting the firing tip to the axial bore.

7. A method of manufacturing a center electrode for a spark plug as recited in claim 1, wherein a flange is provided with a front end of the firing tip, an outer diameter of the flange being equivalent to the outer diameter of the straight neck portion.

8. A method of manufacturing a center electrode for a spark plug as recited in claim 7, wherein laser beams are directed perpendicular to an interface between the flange and an front end of the straight neck portion at the time of bonding the firing tip to the straight neck portion by means of the laser beam welding.

9. A method of manufacturing a center electrode for a spark plug as recited in claim 1 further comprising a step of applying a pressure in a direction in which the firing tip is brought into engagement with the heat-conductor core after providing the firing tip into the axial bore.

10. A method of manufacturing a center electrode for a spark plug as recited in claim 9, wherein the pressure is applied concurrently when the firing tip is bonded to the straight neck portion by means of the laser beam welding.

11. A method of manufacturing a center electrode for a spark plug comprising steps of:

providing a composite column by enclosing a heat-conductor core into a nickel-alloyed clad by means of plastic working;

severing a front end of the nickel-alloyed clad to define a severing end surface;

providing a straight neck portion by diametrically reducing the front end of the nickel-alloyed clad;

providing an axial bore at the straight neck portion of the nickel-alloyed clad to reach to a front end of the heat-conductor core;

providing a firing tip made of precious metal into the axial bore, a front end of the firing tip extending beyond the front end of the straight neck portion, while a rear end of the firing tip being in thermally transferable contact with the front end of the heat-conductor core; and bonding an outer surface of the firing tip to an inner surface of the axial bore by means of laser beam welding or electronic beam welding.

* * * * *